United States Patent [19]

Ritter

[11] 4,144,941

[45] Mar. 20, 1979

[54] DIRECTIONAL IMPACT TOOL FOR TUNNELING

[76] Inventor: Lester L. Ritter, 2860 N. Pascal, St. Paul, Minn. 55113

[21] Appl. No.: 838,239

[22] Filed: Sep. 30, 1977

[51] Int. Cl.[2] ..... E21B 11/02; E21B 7/04

[52] U.S. Cl. ..... 175/19; 175/61; 175/73; 175/390; 173/125

[58] Field of Search ..... 175/19–23, 175/73, 389, 390, 61, 414–420; 173/125, 127, 134–138, 91

[56] References Cited

U.S. PATENT DOCUMENTS

| | | | |
|---|---|---|---|
| 973,887 | 10/1910 | Steinmetz | 175/414 |
| 1,771,312 | 7/1930 | Pierce | 175/19 X |
| 2,648,524 | 8/1953 | Dionisotti | 175/418 X |
| 3,679,005 | 7/1972 | Inaba et al. | 173/137 |
| 3,952,813 | 4/1976 | Chepurnoi | 175/19 X |

FOREIGN PATENT DOCUMENTS

| | | | |
|---|---|---|---|
| 476356 | 7/1975 | U.S.S.R. | 175/19 |

*Primary Examiner*—Ernest R. Purser
*Assistant Examiner*—Richard E. Favreau
*Attorney, Agent, or Firm*—Paul L. Sjoquist

[57] ABSTRACT

A hole-driving tool having an air-operated hammer for impacting against an anvil in the body of the tool to cause the tool to tunnel through the ground, wherein the direction of travel is controlled by providing a variable mass distribution over the hammer and anvil combination, and controlling the relative impact position of the hammer against the anvil.

8 Claims, 3 Drawing Figures

DIRECTIONAL IMPACT TOOL FOR TUNNELING

BACKGROUND OF THE INVENTION

The present invention relates to apparatus for tunneling holes through the ground, and more particularly to air-operated impact devices for tunneling substantially horizontally for the purpose of laying cables or pipes beneath roadbeds or other surface features.

Air-operated impact devices have been used for tunneling to create horizontal or substantially horizontal holes beneath roadbeds and other surface features and objects for the purpose of laying cables and pipes without disturbing the surface. One of the significant problems encountered with such impact devices is the inability to control the direction of travel of the device once it has penetrated the ground. Depending upon the type of ground and soil condition, such a tunneling device may have a tendency toward deviating above the horizontal or below the horizontal, and the type of soil and degree of homogeneity are major factors which determine the direction such an apparatus will tend to follow. Generally, wet clay soils tend to cause the device to rise upwardly toward the ground surface; light sandy soils tend to cause the device to travel along a fairly horizontal and level directional course; sand and gravel soil generally tend to cause the device to deviate in a downwardly direction from horizontal. Further, obstructions in the soil such as rocks may cause the apparatus to become deflected from its normal direction in a totally non-predictable way.

In addition to the foregoing factors affecting directional control of such devices, it has also been found that the depth at which the device is operated in the soil is also a factor. Since the device will generally follow the path of least resistance, it is thought that the looser soil compaction near the surface creates a more well-defined resistance gradient than soils at deeper depths, where compaction tends towards constancy. Thus, for any particular type of soil, there is a preferred minimum depth at which operation minimizes the risk that the apparatus will turn upwardly toward the surface. This step varies with soil type and condition, but may be empirically determined.

There are some applications in which it is desirable to tunnel beneath the ground at a constant depth, but along a non-horizontal direction. Typically, when this is done, the apparatus is started at some non-horizontal angle into the soil, which angle attempts to anticipate the soil conditions and the distance of travel of the apparatus through the soil such that when it emerges at the desired terminus point it is hopefully at the desired soil depth.

A further difficulty in controlling direction for impact devices which tunnel beneath the surface is related directly to the length of the tunnel. It has been found that such devices maintain a fairly accurate directional course over shorter tunneling distances, but with increased distance the directional course becomes more and more unpredictable. For example, a three degree variation in elevational angle of direction can, over the distance of sixty-five feet, cause a three-foot error in the tunnel outlet location. Any small angular deflection caused by contact with an object, if such deviation occurs near the beginning of a tunnel, may cause such a directional deviation as to make it impossible to locate the impact device after it has traveled a substantial distance underground.

In the typical operating environment for this type of device, an excavation must be dug to a sufficient depth at the point where the hole driving operation is to commence. A second excavation is dug at the desired exit point of the hole driving mechanism, again to a depth sufficient to permit the device to cleanly exit from the ground. After these excavations have been prepared the hole driving device is carefully placed at the proper depth in one of them and is aligned in both a horizontal and vertical plane toward the other excavation. The device is then activated to enter the ground and begin tunneling toward the second excavation. After a period of time, which is dependent upon the depth of tunneling, soil material and condition, length of tunnel and other factors, the device will travel underground in a direction generally aligned with its initial position until it exits from the ground at the second excavation. Of course, if any of the factors referred to hereinbefore are of significant influence on the device, it may never exit at the proper location. In that situation it is necessary to locate the position of the device and make a new excavation of that position to retrieve the device.

It is therefore the principal object of the present invention to provide a directional, controllable impact device for tunneling through the ground, wherein the path of tunneling may be corrected, altered and otherwise controlled by an operator.

SUMMARY OF THE INVENTION

The present invention comprises an air-operated impact tool for tunneling beneath the surface of the ground wherein the direction of travel may be controlled by an operator. The tool comprises a reciprocable piston having a hammer at its front end, and a cylindrical outer housing having an anvil at its front end, wherein the hammer mass is axially unbalanced and the piston may be rotatably positioned about its axis of reciprocation so as to control the off-axis impact point of the hammer against the anvil. The anvil also has an axially unbalanced mass complementary-shaped to the hammer front end.

BRIEF DESCRIPTION OF THE DRAWINGS

A preferred embodiment of the invention is disclosed hereinafter, with reference to the appended drawings, in which.

DESCRIPTION OF THE PREFERRED EMBODIMENT

Figure 1:
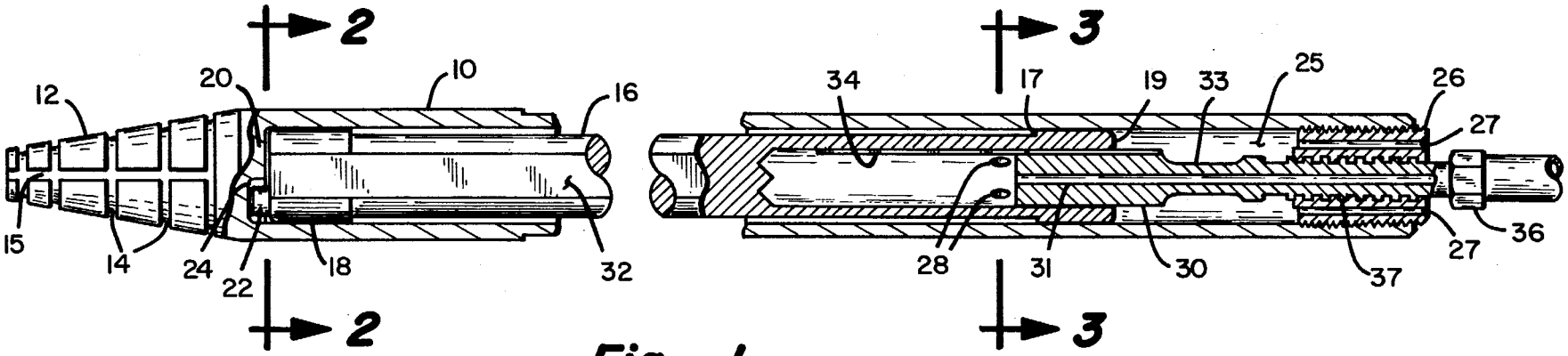
FIG. 1 illustrates the apparatus in plan view and partial cross section.

Referring first to FIG. 1, the invention is shown in plan view and in partial cross section. A cylinder 10 is formed with a closed front tip 12 which is shaped into a more or less pointed front end. Front tip 12 has a plurality of circumferential grooves 14 for providing a frictional gripping force against the soil. These grooves tend to hold cylinder 10 in a relatively fixed position while it is tunneling, thereby to prevent cylinder 10 from reciprocating in coincidence with the piston. A plurality of longitudinal grooves 15 provide a similar frictional gripping force to prevent random rotational movement about the axis of the apparatus. The interior end of front tip 12 comprises an anvil 20, which anvil has an axially displaced recession 24. The rear end of cylinder 10 is threaded to accept an end cap 26. End cap 26 has longitudinal ports 27 for permitting the exhausting of compressed air from within cylinder 10 in a manner to be hereinafter described.

A piston 16 is slidably mounted within cylinder 10. Piston 16 has a solid front piece comprising a hammer 18, which hammer has an axially displaced projection 22. Projection 22 and recession 24 are preferably complementary-shaped so that projection 22 may fit within recession 24. Piston 16 is itself hollow along its interior axial length except for hammer 18. Near the rear end of piston 16 are formed a plurality of ports 28 which exit on flat surfaces formed along the outside surface of piston 16. A key 34 forms a part of the interior surface of piston 16, which key is mated to a corresponding slot in spool 30. Piston 16 and spool 30 are sized for slidable reciprocable movement therebetween.

Spool 30 has a bore 31 drilled along its axial length, which bore comprises a passage for compressed air into the interior of the apparatus via coupler 36 and hose 35. Spool 30 has a narrowed diameter 33 which serves as a valving mechanism in a manner to be hereinafter described. Spool 30 is threadable through end cap 26 by means of jack threads 37.

Hose coupler 36 is designed for attachment to a suitable high pressure air hose 35, and when secure attachment is made it is possible to twist the attached air hose 35 and thereby cause spool 30 to be threadably engaged or disengaged by means of jack threads 37. In this manner, spool 30 may be inserted more deeply into cylinder 10 or may be retracted outwardly toward end cap 26. Because piston 16 is keyed to spool 30 by means of key 34, any rotation of spool 30 about its axis causes a corresponding rotation of piston 16 about the same axis.

Figure 2:
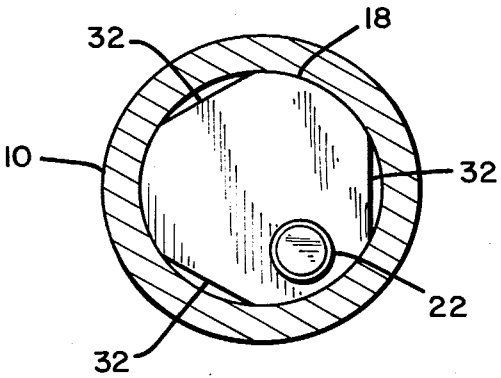
FIG. 2 illustrates the view taken along the lines 2—2 of FIG. 1.

FIG. 2 illustrates a view taken along the lines 2—2 of FIG. 1. Projection 22 is shown as a circular raised portion of hammer 18, although any desired geometric shape may be utilized for projection 22. Flats 32 are milled along three sides of piston 16 and hammer 18 for purposes which will be described hereafter.

Figure 3:
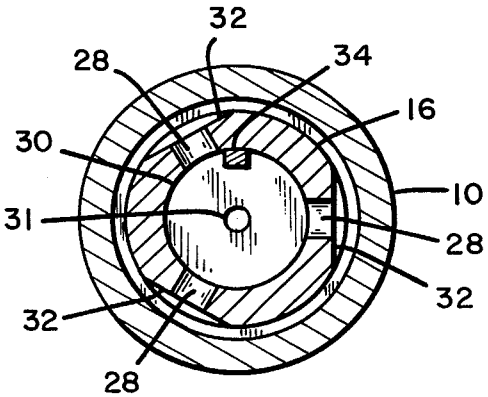
FIG. 3 illustrates the view taken along the lines 3—3 of FIG. 1.

FIG. 3 illustrates a view taken along the lines 3—3 of FIG. 1, wherein the location of ports 28 is shown, each port being centered on a flat surface 32. Ports 28 provide air communication paths between the interior of piston 16 and its exterior. Ports 28 may be covered by spool 30 during at least a portion of the reciprocable travel of piston 16 over spool 30. In the view shown in FIG. 1, piston 16 is in its forwardmost position and ports 28 are uncovered from spool 30. In its rearmost position, piston 16 slides rearward over spool 30 and ports 28 are uncovered by the narrowed diameter 33 of spool 30. At intermediate positions ports 28 may be blocked by the major diameter of spool 30.

In operation, compressed air is applied via the pressure hose attached to coupler 36. The compressed air passes through bore 31 to the interior of piston 16 and exerts a forward-driving force against piston 16. This force causes piston 16 to move sharply ahead, contacting hammer 18 against anvil 20. At its forwardmost position piston 16 uncovers ports 28 and the internally pressurized air is vented to the exterior of piston 16. This vented pressurized air fills the open slots between piston 16's exterior surface and the interior of cylinder 10, and acts upon rear inner piston surface 17 to sharply drive the piston in a rearward direction. The piston proceeds rearward until ports 28 again become uncovered by the narrowed diameter 33 of spool 30. At this point, the compressed air between piston 16 and the interior surface of cylinder 10 is vented into rear chamber 25, and then out ports 27 through end cap 26. When piston 16 is in its rearward position compressed air entering via bore 31 again acts to drive piston 16 forwardly to repeat the cycle.

Spool 31 may be threadably moved along its axis in either direction, thereby varying the stroke range of the apparatus. For example, if spool 30 is positioned in its forward axial position as shown in FIG. 1, the stroke of piston 16 causes hammer 18 to sharply contact anvil 20, thereby producing a forward driving impulse. Conversely, if spool 30 is threaded toward end cap 26, the stroke of piston 16 may be shifted so as to prevent any contact between hammer 18 and anvil 20. If spool 30 is fully retracted toward end cap 26 the stroke of piston 16 may be adjusted so as to cause contact between rear outer piston surface 19 and end cap 26, thereby creating a reverse impulse and causing the apparatus to move in a rearward direction.

Whenever spool 30 is rotated about its axis as hereinbefore described, piston 16 also rotates, due to the key 34 on the inside surface of piston 16 and the mating slot on spool 30. This rotation causes projection 22 of hammer 18 to also become displaced about the axis of piston 16, and to rotatably position the point of impact of projection 22 against anvil 20. In the position illustrated in FIG. 1, projection 22 strikes the interior recession 24 at the same time as the remaining surface of hammer 18 strikes anvil 20. This results in a generally uniform impulse area between hammer 18 and anvil 20, and provides a generally straight directional impulse. However, if spool 30 and piston 16 are rotated by some angular increment about their axis, the contact point of projection 22 will be against anvil 20 at a point other than at recession 24. In this case, the contact impulse forces are off-axis forces, thereby creating a driving impulse force tending to cause anvil 20 and cylinder 10 to veer from a straight directional path.

Under typical operating conditions piston 16 is reciprocated at rates approaching sixty times per second, so that each impulse of hammer 18 against anvil 20 causes a small forwardly directed movement. If projection 22 contacts anvil 20 at any point other than recession 24 the forward motion tends to deviate in response to this off-axis force and the apparatus will gradually turn in a direction away from the off-axis point of contact. In this manner, the apparatus may be turned right or left, or up or down, depending upon the operator's adjustment of the axial rotation of the air hose and spool 30. This permits the operator to control the direction of movement of the apparatus through the ground, and permits him to steer the apparatus in any relative direction by merely controlling the air hose axial rotation. If the operator desires to reverse the tunneling direction of the apparatus he merely turns the hose a number of revolutions to cause the rear end of piston 16 to constact end cap 26, and the internal impulse forces will drive the apparatus backward. Since the rear end of piston 16 is uniformly constructed, the rearward motion will tend to be along a straight line, although in actual practice the apparatus will proceed rearwardly out of the same tunnel it created during its forward motion.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In an impact tool for tunneling through the ground by means of a reciprocable hammer which is slidably axially contained within a cylinder having an inner end surface, comprising an anvil having a recession therein in an off-axis position relative to said hammer, and an off-axis mass on said hammer, wherein said off-axis recession in said anvil is complementary-shaped with said hammer off-axis mass and sized to receive said mass.

2. The apparatus of claim 1, further comprising means for rotating said hammer about its sliding axis.

3. The apparatus of claim 2, further comprising an air hose coupled to said impact tool and means for connecting said air hose to said means for rotating said hammer, whereby twisting of said air hose causes rotation of said hammer about its axis.

4. The apparatus of claim 1, wherein said cylinder further comprises an exterior pointed surface having circumferential grooves therein.

5. The apparatus of claim 4, wherein said exterior pointed surface further comprises at least one longitudinal groove therein.

6. A pressurized air-operated impact tool for directional tunneling through the ground, comprising (a) a cylinder having a tapered front end enclosing a mass having an internal striking surface, said internal striking surface having an off-axis recession therein;

(b) a piston axially slidably housed within said cylinder, said piston having an enclosed front end mass having a flat front surface with a raised off-axis projection;

(c) air valve means for selectively directing pressurized air against said piston to cause reciprocable axial piston movement within said cylinder; and (d) means for rotatable positioning said piston about its axis of sliding.

7. The apparatus of claim 6, wherein said cylinder mass internal striking surface further comprises a shape complementary with said piston front end mass.

8. The apparatus of claim 7, wherein said cylinder mass internal striking surface further comprises a recession complementary-shaped with said piston raised off-axis projection and sized to receive said projection.

* * * * *